US007442229B2

(12) United States Patent
Sterneland et al.

(10) Patent No.: US 7,442,229 B2
(45) Date of Patent: Oct. 28, 2008

(54) METHOD TO IMPROVE IRON PRODUCTION RATE IN A BLAST FURNACE

(75) Inventors: Jerker Sterneland, Stockholm (SE); Lawrence Hooey, Raahe (FI)

(73) Assignee: Luossavaara-Kiirunavaara AB, Kiruna (SE)

( * ) Notice: Subject to any disclaimer, the term of this patent is extended or adjusted under 35 U.S.C. 154(b) by 0 days.

(21) Appl. No.: 10/513,885

(22) PCT Filed: May 12, 2003

(86) PCT No.: PCT/SE03/00767

§ 371 (c)(1),
(2), (4) Date: Feb. 1, 2005

(87) PCT Pub. No.: WO03/095682

PCT Pub. Date: Nov. 20, 2003

(65) Prior Publication Data

US 2005/0126342 A1 Jun. 16, 2005

(30) Foreign Application Priority Data

May 10, 2002 (SE) ..... 0201453

(51) Int. Cl.
*C21B 3/02* (2006.01)
*C22B 1/04* (2006.01)
*C22B 1/16* (2006.01)

(52) U.S. Cl. ..... 75/469; 75/772; 75/472

(58) Field of Classification Search ..... 75/458, 75/459, 469, 472, 772
See application file for complete search history.

(56) References Cited

U.S. PATENT DOCUMENTS 3,163,519 A 12/1964 Hanson et al.
3,894,865 A * 7/1975 Wienert ..... 75/10.67
4,231,797 A 11/1980 Fujita et al.
4,350,523 A 9/1982 Taguchi et al.
4,963,185 A * 10/1990 Ellenbaum et al. ..... 75/319
5,127,939 A 7/1992 Panigrahy et al.
5,294,243 A 3/1994 Taft et al.
5,476,532 A * 12/1995 Steeghs ..... 75/300
6,332,912 B1 12/2001 Klemo
6,676,725 B2 * 1/2004 Aota et al. ..... 75/246
2002/0164280 A1 * 11/2002 Kinnen et al. ..... 423/432

FOREIGN PATENT DOCUMENTS

JP 53102204 A * 9/1978
JP 2080522 * 3/1990
KR 2001-048637 A * 6/2001

OTHER PUBLICATIONS

English abstract of KR 2001-048637 A.*
English abstract of JP 53102204 A.*
CRC Handbook of Chemistry and Physics, p. B-81, 1989.*
"Grit and Microgrit Grading Conversion Chart" from http://www.reade.com/Sieve/grit_conversion.html accessed Jan. 9, 2008. copyright 1997.*

* cited by examiner

*Primary Examiner*—Roy King
*Assistant Examiner*—Tima M McGuthry-Banks
(74) *Attorney, Agent, or Firm*—Nixon & Vanderhye P.C.

(57) ABSTRACT

The present invention relates to a method to improve the iron production rate in a blast furnace being charged by iron containing agglomerates. The method includes contacting the chargeable iron containing material with a slag modifying effective amount of a dispersion of a particulate material, wherein the contacting occurs prior to the charging of the agglomerate to blast furnace process.

25 Claims, 2 Drawing Sheets

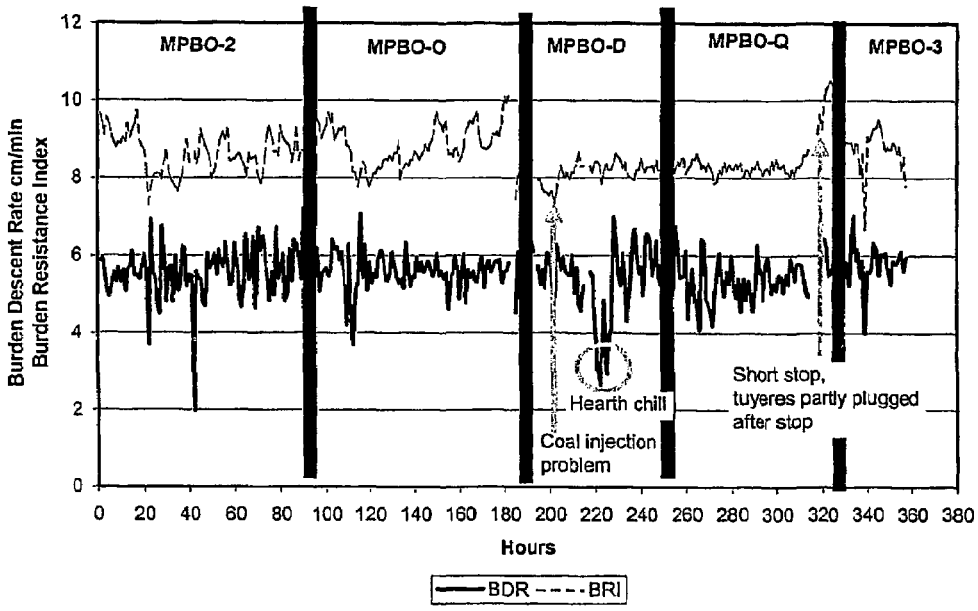

FIG.1. Burden descent rate and burden resistance index for trials in the experimental blast furnace with MPBO pellets uncoated and coated with various minerals.

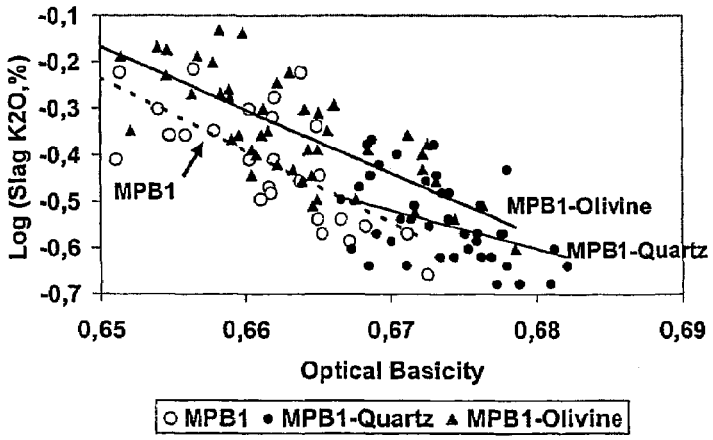

Fig. 2. Output of potassium oxide via slag as a function of optical basicity[1)] for operating periods with MPB1 pellets and MPB1 pellets with coatings of quartzite and olivine. [1)] see Slag Atlas, 2nd Edition, VDEh ed.,Verlag Stahleisen GmbH, Düsseldorf, 1995, p.11.

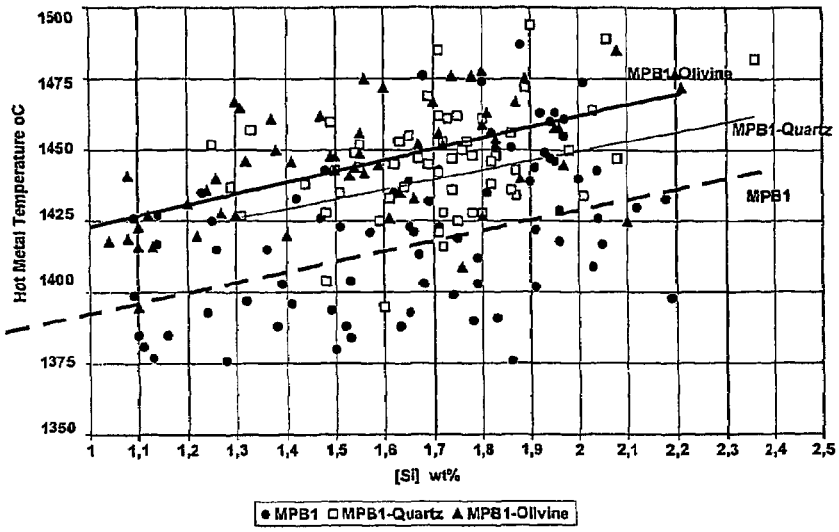

Fig. 3. Hot metal temperature as a function of silicon content for MPB1 pellets and MPB1 pellets coated with olivine and quartzite.

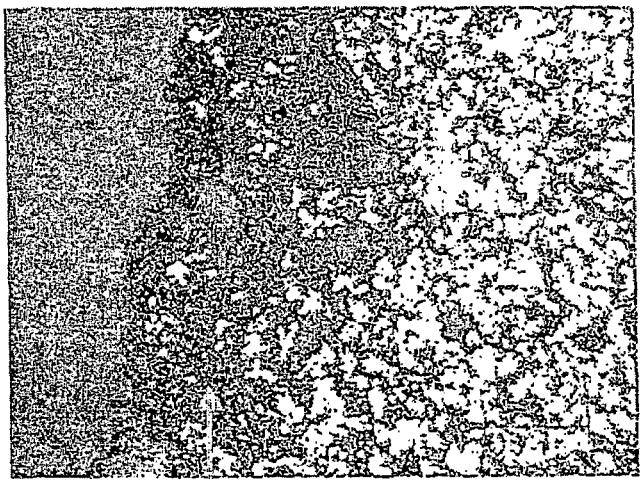

approx. Assay: 30% $K_2O$, 35% $SiO_2$, 19% $Al_2O_3$

Figure 4. Micrograph of MPBO-kaolinite coated pellet removed from the lower shaft of the experimental blast furnace with visible coating remaining. SEM microprobe analysis shows potassium alumino-silicates forming and kalsilite was identified by x-ray diffration.

METHOD TO IMPROVE IRON PRODUCTION RATE IN A BLAST FURNACE

This application is a US national phase of international application PCT/SE03/00767 filed in English on 12 May 2003, which designated the US and claims priority to SE Application No. 0201453-8, filed 10 May 2002, each incorporated herein by reference in its entirety.

The present invention relates to a method to improve iron production rate in a blast furnace in accordance with the preamble of claim 1.

BACKGROUND OF THE INVENTION

This invention relates generally to affecting reactions between blast furnace gas and minerals present in the blast furnace shaft, and relates to the distribution of minerals with relation to the formation of molten slag. There are also factors related to dust suppression in iron ore agglomerate handling and transport.

Iron oxide pellets are normally used alone or together with natural lump ores or sinter as iron units in blast furnaces. In the high temperature region of the furnace, above approximately 1000° C., reduction of iron oxide to metallic iron accelerates rapidly. It has been found during this rapid reduction step that iron ore agglomerates may cluster due to iron-iron sintering or the formation of low melting point surface slag. As the temperatures increase further, slag forming material in the agglomerates begin to melt and eventually exude from the agglomerates. The primary slags tend to be acidic in nature. These so-called primary slags contain residual FeO which is then reduced via contact with reducing gas or carbon. Iron in contact with carbon carburises and melts. Slags formed in the primary process react with other lumpy slag formers in the burden to form secondary slags, and then eventually with residual coke ash to form the final slag that is tapped from the furnace. It has been found that this melting process—including slag and iron meltdown and carburisation—affects greatly the stability in the melting zone and hearth of the furnace, and can affect gas flow. Maintaining fluid slags throughout the process is critical to stable operation. This is especially important for furnaces operating with very low slag volumes as the basicity of the secondary slag in the ore layer becomes higher with greater risk of extreme differences in melting temperatures between primary slag and secondary slag. In some instances, due to the endothermic reduction of FeO and melting of iron, slags may refreeze blocking gas flow through the ore layer and delaying further reduction and melting. Improving the distribution of slag formers reduces the extremes in differences in slag melting temperatures.

In the very high temperatures at the tuyeres and hearth, some of the alkalis (potassium and sodium) entering with the charge material are reduced and vaporized, rising with the gas in the shaft. As the alkalis rise, they react first with acid components in the burden which are well known to capture alkali. Alkalis not captured in the acid components continue to ascend and are deposited as carbonates and cyanides. These depositions are known to cause scaffolding, hanging and also react with the refractory lining of the furnace. Also, the presence of alkali in reducing gas has been shown to cause degradation of coke and iron ore agglomerates which results in permeability problems in the packed bed. The degree of alkali circulation and the behaviour of the coke and ferrous burden in the presence of alkali are constant sources of concern in blast furnace operations.

The phenomena of clustering of ores, poor slag formation and meltdown behaviour and alkali circulation result in less efficient gas-solid contact, unstable burden descent and unstable hot metal quality requiring a higher blast furnace fuel rate that results in a lower productivity.

There are several mineralogical factors to be considered that impact on these behaviours. Improving any of the following behaviours improves the blast furnace process and can increase blast furnace productivity and efficiency.

First of all, acid materials—namely materials containing substantial amounts of silica or alumina, react strongly with alkalis to bind them in forms more stable than carbonates or cyanides. Alkalis circulating in the form of carbonates or cyanides deposit in the shaft to block gas flow, cause scaffolds to form on the walls, clustering of the ore layers, and react with coke or agglomerates causing degradation. Addition of silica, in the form of gravel, for example is effective in adjusting the final tapped slag composition, however the particle size of such gravel, generally charged at +6 mm, yields a rather low surface area for gas-solid reaction. Due to the low surface of bulk additives, the reaction with alkalis is not maximised.

Secondly, when the agglomerates begin to melt down, acidic slags are the first to flow from iron ore agglomerates. The slags require fluxing by network-breaking oxides such as CaO and MgO which may be added as bulk solids such as lumpy limestone, converter slag, dolomite or olivine, typically in particulate sizes much greater than 6 mm. However, due to the heterogeneous distribution of the fluxing particles extreme slag compositions may be present resulting in high viscosity slags blocking gas flow and potentially causing clustering of pellets, or in worst case, refreezing of slag causing extreme channelling of gas and hanging.

Thirdly, the clustering of iron ore agglomerates, due to either solid-state sintering of iron or low melting point surface slag can be alleviated by application of a high melting point mineral layer at the contact points between agglomerates. Clustering has been reduced in the DR process by applying high-melting point minerals to the DR pellet surface.

A final consideration that is not related to the chemical behaviour of the furnace is the water spraying typically used to minimise dusting in transport. Moisture in the pellets is to be avoided as it depresses blast furnace top gas temperatures which in some cases requires more fuel and therefore lowers blast furnace productivity. Dust suppression is also important in the blast furnace process because dusts escaping with blast furnace gas must be recovered and disposed of. Such dusts, commonly called flue dusts, are both a loss of iron units and expensive to dispose of or recycle. Furthermore, reducing the dusting in transport lessens iron unit losses and improves the environmental aspect of blast furnace ironmaking.

U.S. Pat. No. 4,350,523 discloses iron ore pellets when used in a blast furnace reduces the coke and fuel rates and also frequency of slips and the fluctuations in the blast furnace process. According to the document the reducibility of the pellets (the so called retardation of reduction) in the high temperature zone is improved by increasing the porosity and pore diameters of the individual pellets. The pellets are manufactured by adding a combustible material to the pellets during the pelletizing process before firing of the pellets.

RU 173 721 discloses the problems of loosening and breakage of pellets in the upper part of a reducing unit and the problems of sticking of pellets during the intensive formation of metallic iron in the middle and lower part of the furnace shaft. In accordance with the teachings of the document the problems are reduced by applying a coating of CaO and/or MgO-containing materials to the green pellets just prior to firing. By altering the basicity of the surface layer, the reduction properties of the pellets are improved.

Although blast furnace efficiency and productivity has steadily improved through various means, the process can still be improved. The object of the present invention is therefore to provide a method that improves fuel efficiency and stability, and thereby production rate, in such a way that does not alter the fired pellet reducibility or reduction degradation properties. The means to provide such improvements are to reduce the amount of gas channeling, slipping and dust formation via improved slag formation and melting behaviour, reduction of the degree of clustering of iron ore agglomerates, and reduction or modification of the circulation of alkalis in the blast furnace.

Accordingly, the development and proposals suggested herein surprisingly have shown to improve the efficiency and the production rate in blast furnaces.

SUMMARY OF THE INVENTION

The invention is a method to improve the iron production rate in a blast furnace being charged by iron containing agglomerates comprising contacting the chargeable iron containing material with a slag modifying effective amount of a dispersion of a particulate material, said contacting occur prior to the blast furnace procedure. Coating iron containing material such as pellets which immediately is chargeable to a blast furnace gives a number of advantages in comparison to applying a coating on green pellets. One advantage of coating the fired pellets is that the fundamental properties of the pellets are not altered by the coating procedure, therefore any coating material may be used without altering pellet strength or reducibility. A second advantage to coating the fired pellets is that the coating material enters the blast furnace mineralogically unaltered and with a much higher surface area for reaction thereby promoting desired gas-solid reactions.

The slag modifying effective particulate material can be selected from the group consisting of, a lime bearing material comprising burnt lime, limestone, dolomite; a magnesium bearing material comprising magnesite, olivine, serpentine and periclase; an aluminium bearing material comprising bauxite, bauxitic clays, and kaolinites, kaolinitic clays, mullite, corundum, bentonite, sillimanites, refractory clays; or a silica bearing material comprising quartzite or any silica minerals; or oxide bearing material comprising barium oxide; or other typical material used such as ilmenite, rutile.

Coating of the fired blast furnace pellets is preferred before the first handling that results in environmentally sensitive dusting, such as loading at the loading port. Coating could also be performed just (after firing or just) prior to charging to the blast furnace.

A part of the coating mixture may be a binder material, such as a clay, or cement type of materials, which can harden onto the particles holding the coating mixture in place on the surface.

In order to reduce alkali circulation in the blast furnace process or improve the slag melting behaviour of iron ore pellets, the present inventors investigated extensively the possibility to maximise reactive mineral surface areas and improve slag former distribution. This maximisation accomplished by dispersing a coating of various minerals on the surface of fired pellets. Control of dust generation in transport, handling and control of generation of flue dust were investigated for possible improvement in combination with the investigation of maximisation of reactive surface area to achieve multiple benefits from one invention.

After a series of investigations, improvement in blast furnace process were proven through applying a dispersion containing certain particulate solids known, or believed to have a specific behaviour in the blast furnace process onto iron ore pellets. Furthermore, coating with the dispersion may be optimised for maximum dust suppression thereby minimising the required moisture of the coated pellet for transport and handling.

The effective surface area of the slurry is several orders of magnitude higher than charging the coating mineral as a bulk solid, and therefore much more reactive. In this way, minerals that react with alkalis, referred to hereafter as alkali-reactive materials, can capture the maximum amount of alkali in a form more stable than carbonates or cyanides which are known to be responsible for alkali circulation high in the blast furnace shaft. Removing alkali from the gas using a mineral dispersed on the pellet surface limits reaction of alkalis with coke that causes coke degradation, or deposit on the refractories causing scaffolds and refractory damage.

By applying a mineral coating over the pellet surface, primary slags flowing from pellets can be made to be more uniform in the critical reaction surface when generally acidic primary slags begin to exude. It should be noted that for acid material reacted with alkalis, there would be an improvement in slag formation because potassium and sodium oxides lower the viscosity of acidic slags very strongly.

By applying a dispersion containing fine particulate solids with controlled grain sizes and different surface polarisation compared to the iron oxides, individual particles that would otherwise end up as liberated dusts adhere to the pellet surface more effectively. This strong adherence reducing both dusting in transport and the output of dust via blast furnace top gas.

BRIEF DESCRIPTION OF THE DRAWINGS

The invention is explained in more detail below on the basis of an example represented in the following drawings.

FIG. 1. Resistance to gas flow (burden resistance index, BRI) and burden descent rate during experimental blast furnace trails with MPBO pellets tested with coatings of olivine, quartzite and dolomite.

FIG. 2. shows the potassium oxide content of slag as a function of optical basicity during experimental blast furnace trials of MPB1 pellets tested with coatings of olivine and quartzite.

FIG. 3. Shows the relationship between hot metal temperature and silicon during experimental furnace trials of MPB1 pellets tested with coatings of olivine and quartzite.

FIG. 4. Formation of $K_2O$ rich slag on the surface of a kaolinite-coated MPBO pellet removed from the lower shaft of an experimental blast furnace.

DETAILED DESCRIPTION OF THE INVENTION

The present invention relates to a method to improve iron production in a blast furnace being charged by iron containing agglomerates comprising contacting the chargeable iron containing material with a slag modifying effective amount of a dispersion of a particulate material. Said contacting occurring after iron ore agglomeration and prior to charging to the blast furnace shaft.

The chargeable agglomerated material of the present invention may be in any form that is typical for processing in a blast furnace. For non-limiting example, the chargeable material may be ores agglomerated to pellets, briquettes, granulates etc., or natural agglomerated iron oxide ores typically referred to as lump ore or rubble ore.

As used herein, "dispersion" means any distribution or mixture of fine, finely divided and/or powdered solid material in liquid medium. The similar terms "slurry", "suspension", etc. are also included in the term "dispersion".

As used herein, "slag modifying material" is understood as any materials active in the slag formation process. The main effect of the material can be to capture alkali in the blast furnace gas. As used herein "alkali-reactive material" is to be understood as any material that can aid in the slag formation process by improving the distribution or composition of added slag formers. Further as used herein, "fluxing-effective material" means any material the main effect of which is to decrease the clustering of the chargeable iron containing material after reduction by preventing solid state sintering of the formation of low melting point surface slag. These materials are also referred to as being "cluster abating effective" materials.

In one embodiment, the iron containing agglomerates are in the form of pellets comprising a binder or other additives employed in iron ore pellet formation. Typical binders and additives as well as the method of use of binders and additives are well known. For non-limiting examples such binders and additives may be clays such as bentonite, alkali metal salt of carboxymethyl cellulose (CMC), sodium chloride and sodium glycolate, and other polysaccharides or synthetic water-soluble polymers.

The dispersion of the present invention may optionally employ a stabilizing system which assist in maintaining a stable dispersion and enhances adhesion of the particulate material to the reducible iron containing agglomerates and/or allows for higher solids content of the dispersion. Any conventional known stabilizing system can be employed in this regard with the provision that they assist in stabilizing the dispersion. Examples of such stabilizers are organic dispersants such as polyacrylates, polyacrylate derivaties and the like and inorganic dispersants including caustic soda, ash, phosphates and the like. Preferred stabilizers include both organic and inorganic stabilizers including xanthan gums or derivaties thereof, cellulose derivaties such as hydroxyethyl cellulose carboxymethylcellulose and synthetic viscosity modifiers such as polyacrylamides and the like.

As used herein a "particulate material", is a finely divided powder like material capable of forming a dispersion in a liquid medium such as water.

Any fluxing agents or additives conventionally employed in iron and steelmaking can be utilised in the dispersion of the present invention. Preferred are lime-bearing or magnesium-bearing materials and a number of non-limiting examples are burnt lime, magnesite, dolomite, olivine, serpentine, limestone, ilmenite.

Any alkali-reactive minerals can be utilised in the dispersion of the present invention. Typical non-limiting examples are quartzite, bauxite or bauxitic clays, kaolinite or kaolinitic clays, mullite.

The size of the particulate in the dispersion is determined by type of particulate material and its ability to form a dispersion in a medium such as water. In general, the medium size of the particulate material will be in the range of 0.05 μm to about 500 μm.

In carrying out the inventive method a variety of techniques may be used to contact the chargeable iron containing agglomerates with the particulate material. The methods preferably employed involve forming a dispersion which is contacted with the agglomerated material.

The invention was tested for effects in the blast furnace process in a series of experiments in both laboratory and pilot-scale. Two types of iron ore pellets were tested with various coatings: MPBO pellets (standard LKAB Olivine pellets) and MPB1 (LKAB experimental pellets). The improved dust-suppression during transport and handling was verified in a full-scale test with coated MPBO pellets.

In the first series of tests, standard MPBO pellets were evaluated. The chemical analyses of the pellets are shown in Table 1. MPBO-2 and MPBO-3 are similar types of pellets, wherein both are olivine pellets with addition of olivine and a small amount of limestone, and in the MPBO-3 pellet also a small amount of quartzite was added.

The MPBO-3 pellet was used as the base pellet for the coating experiments, while both uncoated MPBO-2 and MPBO-3 were used as reference materials in the experimental blast furnace. The pellets were coated with different types of coating materials wherein three types of coating materials were used in this investigation: olivine, quartzite and dolomite. All of them were mixed with 9% of bentonite as a binding phase. Chemical analyses of the coating materials are also shown in Table 1, whilst the size distributions of the coating materials are shown in Table 2, as fractions in different size ranges. All materials used are very similar in size, with most part <45 μm (65-70%) and only small amounts >0.125 mm (1-6%).

During the coating procedure, pellets were removed from the pellet bin on a conveyor belt. At the transfer point to a second conveyor belt, pre-mixed coating slurry was sprayed through two nozzles onto the stream of pellets. The coating slurry constituted the coating agent mixed with bentonite as described above, and water added to arrive at a solid content of 25%. The flows of coating slurry and pellets were adjusted to apply an amount of 4 kg of solid coating materials per ton of pellet product.

Chemical analysis of the base pellets and the coated pellets are given in Table 3, where chemical analyses of the pellets sampled at the blast furnace site are also given. The coating materials were found to remain on the pellet surfaces after storage, transport, handling and screening (undersize <6 mm screened off before charging to the blast furnace).

To investigate the behaviour of the coated pellets in laboratory-scale a reduction under load test commonly used for blast furnace pellets was employed, the ISO 7992 test. The ISO 7992 test was appended with a drop test for measuring sticking after reduction.

In the ISO 7992 test, 1200 g of pellets are reduced isothermally at 1050° C. to 80% reduction degree, with a load of 500 g/cm$^2$ on the sample bed during reduction in an atmosphere of 2% $H_2$, 40% CO and 58% $N_2$. From the viewpoint of simulating the conditions in the blast furnace shaft, the ISO 7992 test with addition dropping procedure is a suitable sticking test for blast furnace pellets. The test temperature of 1050° C. is suitable because it is approximately the temperature at the lower end of the reserve zone where the pellets begin to be exposed to stronger reducing gas and reduction to metallic iron begins to accelerate. A small amount of molten slag may also form. The sample is then cooled in nitrogen and the clustered part of the sample is treated in a 1.0 meter drop test, for up to 20 drops. The result of the test is a sticking index value describing the tendency for sticking, SI from 0 (no agglomerated particles before commencing the drop test) to 100 (all particles agglomerated even after 20 drops). The results of this test are shown in Table 4. Clearly dolomite and olivine are affecting the sticking measurement. However quartzite has no measurable effect in the laboratory sticking test. It should be noted that the mineralogy of the coating material may change dramatically due to reactions inside the blast furnace, and the sticking index primarily indicates that there is an effect on the surface and material remains on the surface. Results of laboratory reduction and sticking tests do not necessarily correlate to or explain the effect in blast furnace operation.

Results of mechanical and metallurgical tests are shown in Table 5. Most parameters related to pellet quality are marginally or not at all affected by the use of coating. A decrease in the Cold Compression Strength (CCS) is obtained, by 13 to 29 daN/pellet or 6 to 12%, and in the Low Temperature Disintegration value (LTD), up to 18 percentage units in the >6.3 mm fraction. Both of these changes were actually caused by well-known effects of adding water to iron ore pellets, not caused by the coating materials.

In the first series of pilot-scale tests, the coated MPBO pellets described above were charged to the 1.2 hearth diameter LKAB experimental blast furnace.

The trial was divided into five different periods:

| | |
|---|---|
| MPBO-2 | Reference period using pellets without coating |
| MPBO-O | Olivine coated MPBO-3 pellets |
| MPBO-D | Dolomite coated MPBO-3 pellets |
| MPBO-Q | Quartzite coated MPBO-3 pellets |
| MPBO-3 | Reference period using pellets without coating |

Both MPBO-2 and MPBO-3 pellets types have been operated at SSAB Tunnplåt (Luleå) and SSAB Oxelösund in Sweden, and at Fundia Koverhar in Finland, without showing any significant difference in blast furnace operation.

Table 6 shows the moisture contents of the pellets and the amounts of lumpy slag formers charged to the blast furnace for each of the trial periods. The MPBO-2 pellets were dry (less than 0.1% moisture), while the MPBO-3 pellets had a moisture content of 2.2%. The amount of moisture added to the pellets during the coating procedure corresponded to about 1.5%, and exposure to precipitation resulted in the pellet moisture increasing by a further 0.6 to 0.8%.

The amount of limestone charged in the burden was kept at an almost constant level in all periods. In order to keep the target slag basicity and volume, the amount of basic BOF-slag addition and lumpy quartzite addition were adjusted to compensate for the different chemistry of the different coating materials used.

The primary objective of this trial was to maintain stable operation and establish the effect on flue dust generation, rather than minimise fuel rate and maximise furnace productivity. Furnace blast conditions are shown in Table 7. The primary indicators of the process stability are stability in burden descent and the stability of burden resistance index (BRI), calculated according to equation 1.

$$BRI=([\text{blast pressure}]^2-[\text{top pressure}]^2)/([\text{bosh gas volume}]^{1.7}\times\text{constant}) \quad \text{Equation 1.}$$

In the first series of tests, the descent rate showed clear improvement only in the case of the olivine-coated MPBO pellets and the resistance to gas flow was markedly stable when using quartzite coated pellets, FIG. 1. The improvement in descent rate with olivine-coating can be attributed to reduced clustering effect. The resistance to gas flow is primarily related to the meltdown behaviour of the pellets. Due to fluctuations in the coal injection system its use for comparison is not conclusive. However, in the case of the quartzite-coated MPBO pellets the stability is extremely good, and even during recovery from hearth chilling in the dolomite-coated MPBO period the resistance to gas flow remained stable. The general conclusion was that the operation with the coated pellets was more stable than with the reference uncoated pellets.

The volume of dusts carried out via top gas and collected as flue dust decreased markedly for coated pellets compared to uncoated pellets. Table 8 shows the amounts of flue dust collected, and its composition. An average size distribution of the collected flue dust was shown in Table 2. It can be seen that the flue dust was considerably coarser than the materials used for coating in this test. The finer part of the flue dust passes through the dust catcher cyclone and is collected by a subsequent wet electrostatic precipitator, in the form of sludge. Table 9 shows the composition of the blast furnace sludge from the different periods.

A significant decrease in blast furnace flue dust collected in the dry dust catcher cyclone was observed during the trials with coated pellets, shown in Table 7. The flue dust volumes were markedly lower for all three periods with coated pellets compared to the uncoated pellets. The mass balances based on chemical analyses of the flue dust in Table 7 show that pellet material as the flue dust leaving the furnace decreased by about two thirds. These observations were further confirmed by the fact that in the wet part of the flue dust, i.e. the sludge, the content of iron was also decreased when using coated pellets, as can be seen in Table 8.

It should also be noted that the amounts of fine particles formed by coke fines as well as the lumpy slag formers charged were all lower for the periods with coated pellets and with the wet MPBO-3 pellet than for the period with dry MPBO-2 pellet. The cause is believed to be the effect of dust adhesion to the surface of wet or coated, wet pellets.

It was expected that the use of an acid coating material (either quartzite or, to a lesser extent olivine) should give a better alkali removal by the slag during the blast furnace operation. This was expected due to very high surface area of the coating material available for reaction. However, this expected effect was not verified during the first series of tests with MPBO pellets. The MPBO pellet was already known from probe samples from the experimental blast furnace to have a reasonably good ability to pick up alkali, and the output may be affected only by the composition of the final blast furnace slag. However, the internal circulation of alkalis was expected to be altered by the quartzite coating, with high alkali content silicate slags forming on the pellet surface and this is reflected in the improved stability of the resistance to gas flow.

In a second trial series the behaviour of the experimental blast furnace with coated experimental pellets, called MPB1 pellets, compositions given in Table 10, was evaluated. The alkali output was studied in detail. It was considered that the alkali absorption into this type of pellet was poorer than the MPBO-type of pellet due to the mineralogy of the slag formed in the pellet during firing. MPBO pellets contain some unreacted olivine and pyroxenic phases that react with alkalis. In the MPB1 pellets, the slag former in the pellet is mostly amorphous slag that was seen to be unreactive with alkali.

The MPB1 pellets were coated using a water-based dispersion to yield 3.6 kg quartzite and 0.4 kg bentonite; and 3.6 kg olivine plus 0.4 kg bentonite per tonne pellet respectively. MPB1 pellets were coated with water without any particulates as a reference. The coating procedure was essentially the same as for the trials with MPBO described previously. Once again stability was the objective of the operation, rather than fuel rate and productivity optimisation.

FIG. 2 shows the alkali output via slag demonstrating clearly improved alkali removal via slag with olivine or quartzite coated MPB1 pellets compared to reference MPB1 pellets. The furnace was warmer in the period with the quartzite coated MPB1 pellets resulting in the different slag basicity distribution. In spite of this, both types of coating showed improved alkali output for a given slag optical basicity. The burden descent was also smoother using the coated pellets as shown in Table 11. The burden resistance index remained unaltered, with the deviation increasing slight for the quartzite-coated pellet, but this must be interpreted in conjunction with the rather high hot metal silicon content due to the furnace being overfuelled. With a slightly trimmed fuel rate during the olivine-coated pellet period, the resistance to gas flow was lower and more stable than the reference period.

Moreover, the use of the coated-MPB1 pellets improved hot metal temperature as a function of hot metal silicon content. FIG. 3 shows the results for the quartzite and olivine coated MPB1 pellets. Operation at a lower hot metal silicon content maintaining hot metal temperature has the advantages in the blast furnace process of allowing a lower coke rate and therefore high production rate, as well as minimising iron losses to converter slag, thereby improving overall yield of iron in the steelmaking process. Both reduction in clustering and alkali circulation are factors affecting temperature and hot metal Si relationship. The lower scatter in silicon and temperature for the coated MPB1 pellets indicates a more stable melting zone and gas-solid contact in the lower part of the furnace. Severe clustering can result in unmelted clustered material descending into the hearth reducing the temperature of the molten iron. Secondly, alkali circulation acts as a heat pump by reducing in the high temperature region and oxidising and solidifying at lower temperatures in the shaft thereby removing heat available to the metal in the higher temperature zone. Also, alkali deposition in the shaft produces dusts, for example carbonates, which are easily recirculated and may deposit high in the shaft and are well-know to cause hanging and scaffolding.

In a third test series MPBO pellets were coated using a similar dispersion system to yield 3.6 kg kaolinite and 0.4 kg bentonite per tonne pellets. Table 12 shows the composition of the reference MPBO sprayed with water in the same amount as the coated pellets, and the composition of the coated pellets. In the burden was included 20% of another pellet used together with 80% MBPO pellets in a commercial blast furnace. The burden structure was kept constant with 80% MPBO pellets (coated or uncoated) and 20% of the other pellet.

In the test periods with the kaolinite-coated MPBO pellets and reference MPBO pellets, the fuel rate was trimmed aggressively during the test periods to optimise the fuel rate. The furnace was operated with oil injection that gives more stable and reliable operational data than coal injection. Coal injection rate and combustion behaviours are not as stable as oil injection systems or oil combustion at the rates used in these tests.

The key results of the experimental blast furnace operation are shown in Table 13. The kaolinite-coated pellets resulted in smoother burden descent shown as a lower standard deviation in descent rate and the complete absence of slips; lower fuel rate by 4 kg/thm; increase in production rate; and very significantly decreased flue dust volume. These results support the interpretation of previous test results and show a decrease in fuel rate, increase in productivity and improved furnace stability.

Examination of samples removed by in-burden probes from the lower shaft region of the furnace show significant reaction between the kaolinite coating and potassium, as predicted. FIG. 4 shows an example of potassium alumino-silicate formation from the kaolinite coating. Kalsilite was identified by x-ray diffraction as a significant reaction product of the kaolinite coating with the blast furnace gas.

In the transport and handling of iron ore pellets dust is an environmental concern. Full-scale transport tests were performed on kaolinite-coated MPBO pellets coated at 4 kg kaolinite per tonne pellet by spraying with a dispersion of water containing circa 25% solids and no bentonite or other binder used. The dust suppression during handling and transport during loading, unloading and transport via conveyer was found to be significantly better than water alone.

The effectiveness of chosen coating materials must be considered in conjunction with the mineralogy of the pellet being coated. An effective coating on one type of pellet may be ineffective on another type of pellet. The conditions in the furnace, especially related to the sensitivity of the operation to alkali circulation, are important in the selection of the coating. Understanding of the chemical reactions between gas and minerals, and the crucial factors in the slag formation process are required to chose the optimum coating for a specific pellet type.

TABLE 1

Chemical analysis of oxide pellets and coating materials (weight percent).

| Material | MPBO-2 | MPBO-3 | Olivine | Quartz-ite | Dolo-mite | Ben-tonite |
|---|---|---|---|---|---|---|
| Fe (%) | 66.6 | 66.6 | 5.0 | 0.3 | 1.0 | 3.8 |
| $SiO_2$ (%) | 1.78 | 2.00 | 42.20 | 98.00 | 2.00 | 56.30 |
| CaO (%) | 0.32 | 0.22 | 0.80 | 0.02 | 29.50 | 2.83 |
| MgO (%) | 1.48 | 1.42 | 49.50 | 0.09 | 21.00 | 3.73 |
| $Al_2O_3$ (%) | 0.29 | 0.29 | 0.44 | 1.00 | 0.37 | 18.60 |
| $TiO_2$ (%) | 0.39 | 0.37 | 0.03 | 0.03 | 0.00 | 0.83 |
| MnO (%) | 0.06 | 0.05 | 0.00 | 0.01 | 0.10 | 0.06 |
| $K_2O$ (%) | 0.02 | 0.02 | 0.02 | 0.29 | 0.09 | 0.57 |
| $V_2O_5$ (%) | 0.26 | 0.25 | 0.02 | 0.01 | 0.00 | 0.05 |
| $P_2O_5$ (%) | 0.017 | 0.017 | 0.030 | 0.011 | 0.050 | 0.160 |

TABLE 2

Size distribution of the materials used as coating materials, and of the flue dust from the experimental blast furnace.

| Size ranges (mm) | <0.045 | 0.045-0.063 | 0.063-0.075 | 0.075-0.125 | 0.125-0.250 | 0.250-0.500 | 0.500-1 | >1 |
|---|---|---|---|---|---|---|---|---|
| Olivine (%) | 68 | 11 | 5 | 13 | 2 | 1 | 0 | 0 |
| Dolomite (%) | 67 | 13 | 7 | 11 | 1 | 1 | 0 | 0 |
| Quartzite (%) | 70 | 9 | 4 | 10 | 6 | 1 | 0 | 0 |
| Bentonite (%) | 65 | 21 | 10 | 3 | 1 | 0 | 0 | 0 |
| Flue dust (%) | 9 | 11 | 8 | 24 | 35 | 12 | 1 | 0 |

TABLE 3

Compositions of pellets before and after coating (weight percent). Results shown are a) chemical analysis before coating, b) expected analysis after coating (calculated), c) chemical analysis of pellets after coating, and d) chemical analysis of samples taken at the blast furnace site, i.e. after storing (outside 4 to 6 weeks), transport, handling and on-size screening (+6 mm).

| Material | Sample | Coating | $SiO_2$ (%) | MgO (%) | CaO (%) | Fe (%) |
|---|---|---|---|---|---|---|
| MPBO-3 | a) Base material | None | 2.00 | 1.42 | 0.22 | 66.60 |
| MPBO-O | b) Theoretical | Olivine | 2.16 | 1.60 | 0.22 | 66.33 |
| MPBO-O | c) At pellet plant | Olivine | 2.16 | 1.65 | 0.26 | 66.39 |
| MPBO-O | d) At BF site | Olivine | 2.15 | 1.64 | 0.20 | 66.44 |
| MPBO-Q | b) Theoretical | Quartzite | 2.37 | 1.42 | 0.22 | 66.33 |
| MPBO-Q | c) At pellet plant | Quartzite | 2.42 | 1.40 | 0.20 | 66.24 |
| MPBO-Q | d) At BF site | Quartzite | 2.50 | 1.44 | 0.19 | 66.24 |
| MPBO-D | b) Theoretical | Dolomite | 2.01 | 1.50 | 0.31 | 66.33 |
| MPBO-D | c) At pellet plant | Dolomite | 2.01 | 1.50 | 0.38 | 66.49 |
| MPBO-D | d) At BF site | Dolomite | 1.98 | 1.50 | 0.29 | 66.55 |

TABLE 4

Sticking index of uncoated and coated pellets after ISO 7992 reduction-under-load tests and dropping procedure (average of two tests).

| Measured properties | MPBO-3 | MPBO-O | MPBO-D | MPBO-Q |
|---|---|---|---|---|
| Sticking index, SI | 95 | 47 | 35 | 95 |
| Reduction time (min) | 73 | 75 | 75 | 83 |

TABLE 5

Mechanical and metallurgical test results of oxide pellets and coated pellets.

| | ISO Standard | MPBO-3 | MPBO-O | MPBO-D | MPBO-Q |
|---|---|---|---|---|---|
| Cold compression strength (daN/pellet) | ISO 4700 | 232 | 203 | 215 | 219 |
| Tumble strength (% +6.3 mm) | Modified | 95.0 | 95.2 | 95.0 | 94.6 |
| Abrasion (% −0.5 mm) | ISO 3271[1)] | 4.5 | 4.4 | 4.4 | 4.8 |
| Low Temp Disintegration (% +6.3 mm) | ISO 13930 | 67.7 | 49.6 | 67.3 | 56.6 |
| (% −0.5 mm) | | 9.5 | 12.2 | 11.5 | 11.0 |
| Reducibility, R40 (% O/min) | ISO 4695 | 0.52 | 0.53 | 0.56 | 0.54 |
| ITH (% +6.3 mm)[2)] | | 71.8 | 74.8 | 68.4 | 74.1 |
| Pressure drop, Dp ($mmH_2O$) | ISO 7992 | 12.9 | 9.7 | 12.2 | 11.2 |
| Bed shrinkage (%) | | 6.0 | 3.6 | 6.2 | 6.3 |

[1)]3 kg sample (less than ISO 3271, where 15 kg samples are tested).

[2)]Strength after reduction (reduced material from ISO 4695 is mechanically treated and sieved).

TABLE 6

Moisture contents of pellets and amounts of slag formers charged in experimental blast furnace trials.

| Period | MPBO-2 | MPBO-O | MPBO-D | MPBO-Q | MPBO-3 |
|---|---|---|---|---|---|
| Pellet moisture (%) | 0.1 | 2.1 | 2.2 | 2.3 | 2.2 |
| Limestone (kg/tHM) | 48 | 48 | 49 | 49 | 49 |
| BOF-slag (kg/tHM) | 45 | 41 | 42 | 48 | 48 |
| Quartzite (kg/tHM) | 17 | 15 | 17 | 11 | 17 |
| Coke rate (kg/tHM) | 408 | 410 | 414 | 421 | 430 |

TABLE 7

Blast furnace operating parameters during the trials.

| Period | MPBO-2 | MPBO-O | MPBO-D | MPBO-Q | MPBO-3 |
|---|---|---|---|---|---|
| Duration (h) | 85 | 83 | 48 | 68 | 27 |
| Blast temperature (° C.) | 1198 | 1197 | 1198 | 1197 | 1197 |
| Blast volume ($Nm^3/h$) | 1590 | 1589 | 1591 | 1590 | 1570 |
| Coal injection, PCI (kg/tHM) | 133 | 131 | 123 | 127 | 122 |
| Oxygen enrichment (%) | 3.3 | 3.4 | 3.5 | 3.4 | 3.4 |
| Blast moisture ($g/Nm^3$) | 26 | 26 | 27 | 27 | 27 |
| Flame temp. (calculated, ° C.) | 2188 | 2195 | 2201 | 2201 | 2204 |
| Top pressure (bar, gauge) | 1.0 | 1.0 | 1.0 | 1.0 | 1.0 |

TABLE 8

Flue dust amounts, composition (weight percent) and estimated origin.

| Period | MPBO-2 | MPBO-O | MPBO-D | MPBO-Q | MPBO-3 |
|---|---|---|---|---|---|
| Flue dust, dry (kg/tHM) | 5.4 | 2.9 | 2.7 | 3.0 | 4.4 |
| Fe (%) | 21.6 | 13.8 | n.a. | 13.3 | 21.8 |
| $SiO_2$ (%) | 11.1 | 15.9 | n.a. | 20.8 | 17.7 |
| CaO (%) | 16.2 | 14.1 | n.a. | 12.1 | 14.2 |
| MgO (%) | 4.3 | 9.2 | n.a. | 6.3 | 6.8 |
| $Al_2O_3$ (%) | 3.0 | 4.2 | n.a. | 4.0 | 4.0 |
| MnO (%) | 0.3 | 0.4 | n.a. | 0.4 | 0.3 |
| $K_2O$ (%) | 0.3 | 0.5 | n.a. | 0.4 | 0.6 |
| C (%) | 20.4 | 26.0 | n.a. | 31.2 | 16.5 |
| From pellets (kg/tHM) | 1.5 | 0.5 | n.a. | 0.5 | 1.3 |
| From coke (kg/tHM) | 1.4 | 0.9 | n.a. | 1.1 | 0.9 |
| From limestone (kg/tHM) | 1.0 | 0.5 | n.a. | 0.4 | 0.8 |
| From BOF-slag (kg/tHM) | 1.0 | 0.5 | n.a. | 0.5 | 0.7 |
| From quartzite (kg/tHM) | 0.5 | 0.3 | n.a. | 0.3 | 0.7 |
| From olivine coating (kg/tHM) | — | 0.2 | — | — | — |
| From quartzite coating (kg/tHM) | — | — | — | 0.2 | — |

TABLE 9

Chemical analyses (weight percent) of the sludge, collected by a wet electrostatic precipitator, in the experimental blast furnace trials.

| Period | MPBO-2 | MPBO-O | MPBO-D | MPBO-Q | MPBO-3 |
|---|---|---|---|---|---|
| Fe (%) | 6.2 | 2.4 | 1.6 | 1.1 | n.a. |
| $SiO_2$ (%) | 19.2 | 20.2 | 22.6 | 18.2 | n.a. |
| CaO (%) | 8.8 | 7.3 | 8.0 | 7.4 | n.a. |
| MgO (%) | 8.7 | 10.3 | 14.7 | 10.7 | n.a. |
| $Al_2O_3$ (%) | 6.1 | 6.6 | 8.4 | 8.3 | n.a. |
| MnO (%) | 0.6 | 0.5 | 0.7 | 0.5 | n.a. |
| $K_2O$ (%) | 1.2 | 1.1 | 1.0 | 0.7 | n.a. |
| $Na_2O$ (%) | 10.4 | 9.2 | 6.5 | 7.7 | n.a. |
| $V_2O_5$ (%) | 0.2 | 0.2 | 0.2 | 0.1 | n.a. |
| $P_2O_5$ (%) | 0.1 | 0.2 | 0.2 | 0.1 | n.a. |
| C (%) | 16.0 | 17.0 | 11.8 | 12.3 | n.a. |
| S (%) | 0.3 | 0.2 | 0.1 | 0.2 | n.a. |

TABLE 10

Composition and metallurgical properties of MPB1 and coated MPB1 pellets tested in the Experimental Blast Furnace.

| | MPB1 Pellets | MPB1-quartzite coated pellets | MPB1-olivine coated pellets |
|---|---|---|---|
| Fe (wt %) | 66.8 | 66.6 | 66.3 |
| CaO (wt %) | 1.45 | 1.53 | 1.53 |
| MgO (wt %) | 0.31 | 0.35 | 0.49 |
| $SiO_2$ (wt %) | 1.44 | 2.02 | 1.70 |
| $Al_2O_3$ (wt %) | 0.35 | 0.37 | 0.38 |
| Moisture (wt %) | 0.7 | 1.0 | 1.2 |
| Cold compression strength ISO 4700 (daN/pellet) | 291 | 277 | 279 |
| Low Temp Disintegration ISO 13930 (% +6.3 mm) | 78 | 82 | 75 |
| LTD ISO 13930 (% −0.5 mm) | 12 | 10 | 15 |
| Reducibility, R40 ISO 4695 (% O/min) | 1.2 | 1.2 | 1.2 |
| ITH[1)] (% +6.3 mm) | 78 | 83 | 83 |

[1)]Strength after reduction (reduced material from ISO 4695 is mechanically treated and sieved).

TABLE 11

Summary of operating results in the Experimental Blast Furnace comparing MPB1 with coated-MPB1 pellets.

| | MPB1 | MPB1-Quatzite Coated | MPB1-Olivine Coated |
|---|---|---|---|
| Test time (h) | 42 | 67 | 76 |
| Eta CO (%) | 47.4 | 46.9 | 47.5 |
| STD BDR (cm/min) | 0.52 | 0.35 | 0.48 |
| Production rate (t/h) | 1.56 | 1.54 | 1.57 |
| Coke Rate (kg/thm) | 400 | 400 | 396 |
| Coal Rate (kg/thm) | 123 | 127 | 124 |
| Ave hot metal temp (° C.) | 1433 | 1445 | 1450 |
| Ave. Hot metal Si (%) | 1.62 | 1.71 | 1.53 |

TABLE 12

Composition of MPBO pellets and kaolinite-coated MPBO pellets tested in the Experimental Blast Furnace.

| wt % | MPBO Pellets | MPBO-Kaolinite coated Pellets |
|---|---|---|
| Fe | 66.6 | 66.4 |
| CaO | 0.38 | 0.40 |
| MgO | 1.52 | 1.49 |
| $SiO_2$ | 1.74 | 1.98 |
| $Al_2O_3$ | 0.33 | 0.52 |
| Moisture | 1.8 | 16 |

TABLE 13

Summary of operating results in the Experimental Blast Furnace comparing uncoated MPBO pellets with kaolinite coated MPBO pellets.

| | MPBO-Ref | MBPO-kaolinite coated |
|---|---|---|
| Time (h) | 50 | 62 |
| Blast vol. ($nm^3$/h) | 1516 | 1516 |
| Oxygen enrichment ($nm^3$/h) | 101 | 101 |
| Production (t/day) | 34.1 | 34.6 |
| STD BDR (cm/min) | 1.53 | 1.15 |
| BRI (−) | 6.74 | 6.38 |
| STD BRI (−) | 0.33 | 0.21 |

TABLE 13-continued

Summary of operating results in the Experimental Blast Furnace comparing uncoated MPBO pellets with kaolinite coated MPBO pellets.

| | MPBO-Ref | MBPO-kaolinite coated |
|---|---|---|
| Coke rate (kg/thm) | 404 | 403 |
| Oil rate (kg/thm) | 121 | 118 |
| HM Si (%) | 1.24 | 1.23 |
| HM T (° C.) | 1422 | 1425 |
| HM C (%) | 4.49 | 4.56 |
| Flue dust (kg/thm) | 5.6 | 3.6 |
| Number of slips/day | 3.8 | 0.0 |

The invention claimed is:

1. Method to improve the iron production rate in a blast furnace being charged by iron containing agglomerates, the method comprising contacting the fired chargeable iron containing material with a slag modifying effective amount of a dispersion of a particulate material and charging the fired chargeable iron containing material to the blast furnace such that the particulate material enters the blast furnace, wherein said contacting comprises a surface coating layer at least on parts of the outer circumference of the iron containing agglomerates, wherein said contacting occurs prior to charging to the blast furnace process, wherein the dispersion of a particulate material is a material solid to temperatures greater than 1000° C., or when heated forms phases solid to temperatures greater than 1000° C., and wherein the particulate material will be in the range of 0.05 μm to about 500 μm.

2. Method according to claim 1, wherein the slag modifying effective amount of a dispersion comprises any alkali-reactive material.

3. Method according to claim 2, wherein alkali-reactive material includes any aluminium oxide bearing material or any silica or silicon oxide bearing material.

4. Method according to claim 1, wherein the slag modifying effective particulate material is selected from the group consisting of: a lime bearing material comprising burnt lime, limestone, dolomite; a magnesium bearing material comprising magnesite, olivine, serpentine and periclase; an aluminium bearing material comprising bauxite, bauxitic clays, and kaolinites, kaolinitic clays, mullite, corundum, bentonite, sillimanites, refractory clays; or a silica bearing material comprising quartzite or any silica minerals; or oxide bearing material comprising barium oxide; or other typical material used such as ilmenite, rutile.

5. Method according to claim 1, wherein the slag modifying effective amount of a dispersion comprises a solid particulate in a liquid.

6. Method according to claim 1, wherein the slag modifying effective amount of a dispersion is comprised of a typical cluster abating effective material.

7. Method according to claim 6, wherein the typical cluster abating effective material is selected from a group consisting of: a lime bearing material comprising burnt lime, limestone, dolomite; a magnesium bearing material comprising magnesite, olivine, serpentine and periclase; an aluminium bearing material comprising bauxite and kaolinite, mullite, corundum, bentonite, sillimanites, refractory clays; or a silica bearing material comprising quartzite; or oxide bearing material comprising barium oxide; or other typical material used such as ilmenite, rutile.

8. Method according to claim 6, wherein the cluster abating effective amount of a dispersion comprises a solid particulate in a liquid.

9. Method according to claim 1, wherein the effective amount of a dispersion is comprised of a solid particulate as a mix of any typical slag modifying particulate material and any typical cluster abating effective material.

10. Method according to claim 9, wherein the cluster abating effective amount of a dispersion comprises a binder.

11. Method according to claim 10, wherein the binder comprises bentonite, clay, cement type of material or organic material which can harden onto the particles holding the coating mixture in place.

12. Method according claim 1, wherein more than 50% of the particulate material has a particle size less than about 45μm.

13. Method according to claim 1, wherein the dispersion is comprised of a mixture of finely divided material in a liquid medium such as a slurry.

14. Method according to claim 13, wherein the dispersion coating slurry has a solid content between 1% and 90% of the mixture.

15. Method according to claim 14, wherein the dispersion coating slurry has a solid content of about 30% of the mixture.

16. Method according to claim 1, wherein the iron containing agglomerates are in the form of pellets, briquettes or granulates.

17. Method to improve the iron production rate in a blast furnace being charged by iron containing agglomerates, the method comprising contacting the fired chargeable iron containing material with a slag modifying effective amount of a dispersion of a particulate material and charging the fired chargeable iron containing material to the blast furnace such that the particulate material enters the blast furnace, wherein said contacting comprises a surface coating layer at least on parts of the outer circumference of the iron containing agglomerates, and wherein said contacting occurs prior to charging to the blast furnace process, wherein the slag modifying effective amount of a dispersion comprises any alkali-reactive material includes any aluminium oxide bearing material or any silica or silicon oxide bearing material.

18. Method to improve the iron production rate in a blast furnace being charged by iron containing agglomerates, the method comprising contacting the fired chargeable iron containing material with a slag modifying effective amount of a dispersion of a particulate material and charging the fired chargeable iron containing material to the blast furnace such that the particulate material enters the blast furnace, wherein said contacting comprises a surface coating layer at least on parts of the outer circumference of the iron containing agglomerates, and wherein said contacting occurs prior to charging to the blast furnace process, wherein the effective amount of a dispersion is comprised of a solid particulate as a mix of any typical slag modifying particulate material and any typical cluster abating effective material, and wherein the solid particulate is a material solid to temperatures greater than 1000° C., or when heated forms phases solid to temperatures greater than 1000° C.

19. Method to improve the iron production rate in a blast furnace being charged by iron containing agglomerates, the method comprising contacting the fired chargeable iron containing material with a slag modifying effective amount of a dispersion of a particulate material and charging the fired chargeable iron containing material to the blast furnace such that the particulate material enters the blast furnace, wherein said contacting comprises a surface coating layer at least on parts of the outer circumference of the iron containing agglomerates, and wherein said contacting occurs prior to charging to the blast furnace process, wherein the effective amount of a dispersion is comprised of a solid particulate as a mix of any typical slag modifying particulate material and any typical cluster abating effective material, and wherein the cluster abating effective amount of a dispersion comprises a binder.

20. Method according to claim 19, wherein the binder comprises bentonite, clay, cement type of material or organic material which can harden onto the particles holding the coating mixture in place.

21. Method to improve the iron production rate in a blast furnace being charged by iron containing agglomerates, the method comprising contacting the fired chargeable iron containing material with a slag modifying effective amount of a dispersion of a particulate material and charging the fired chargeable iron containing material to the blast furnace such that the particulate material enters the blast furnace, wherein said contacting comprises a surface coating layer at least on parts of the outer circumference of the iron containing agglomerates, and wherein said contacting occurs prior to charging to the blast furnace process, and wherein the particulate material will be in the range of 0.05 μm to about 500 μm.

22. Method to improve the iron production rate in a blast furnace being charged by iron containing agglomerates, the method comprising contacting the fired chargeable iron containing material with a slag modifying effective amount of a dispersion of a particulate material and charging the fired chargeable iron containing material to the blast furnace such that the particulate material enters the blast furnace, wherein said contacting comprises a surface coating layer at least on parts of the outer circumference of the iron containing agglomerates, and wherein said contacting occurs prior to charging to the blast furnace process, wherein more than 50% of the particulate material has a particle size less than about 45 μm.

23. Method to improve the iron production rate in a blast furnace being charged by iron containing agglomerates, the method comprising contacting the fired chargeable iron containing material with a slag modifying effective amount of a dispersion of a particulate material and charging the fired chargeable iron containing material to the blast furnace such that the particulate material enters the blast furnace, wherein said contacting comprises a surface coating layer at least on parts of the outer circumference of the iron containing agglomerates, and wherein said contacting occurs prior to charging to the blast furnace process, wherein the dispersion is comprised of a mixture of finely divided material in a liquid medium such as a slurry.

24. Method according to claim 23, wherein the dispersion coating slurry has a solid content between 1% and 90% of the mixture.

25. Method according to claim 24, wherein the dispersion coating slurry has a solid content of about 30% of the mixture.

* * * * *